United States Patent [19]

Larson

[11] Patent Number: 5,056,171

[45] Date of Patent: Oct. 15, 1991

[54] WATERBED MATTRESS AIR BLEEDER VALVE

[76] Inventor: Lynn D. Larson, 1052 N. Lakeshore Dr., Lincoln, Nebr. 68528

[21] Appl. No.: 675,671

[22] Filed: Mar. 27, 1991

[51] Int. Cl.[5] ..... A47C 27/08

[52] U.S. Cl. ..... 5/451; 5/508; 141/386; 220/855 P

[58] Field of Search ..... 5/451, 450, 449, 441, 5/508; 141/386, 65, 301; 220/85 SP; D6/606

[56] References Cited

U.S. PATENT DOCUMENTS

| | | | |
|---|---|---|---|
| 3,203,665 | 8/1965 | Grant et al. | 220/85 SP |
| 3,856,188 | 12/1974 | Newby | 220/85 SP |
| 4,316,489 | 2/1982 | Bova | 5/451 |

FOREIGN PATENT DOCUMENTS

| | | | |
|---|---|---|---|
| 1489116 | 7/1967 | France | 220/85 SP |
| 975391 | 10/1961 | Netherlands | 220/85 SP |

*Primary Examiner*—Alexander Grosz
*Attorney, Agent, or Firm*—John A. Beehner

[57] ABSTRACT

A standpipe to facilitate bleeding of air through the flexible filler spout of a waterbed mattress includes an elongated cylindrical tube adapted for a frictional slide fit within the spout end fitting so as to afford a substantially liquid tight seal between the tube and end fitting. A lip protrudes outwardly from the bottom of the tube to engage the underside of the spout and thereby resist removal of the standpipe from the spout. A collar at the top end of the standpipe seats upon the spout in the lowered position of the standpipe. A transverse closure plate closes and seals the top end of the standpipe, but air can escape through a sidewall opening adjacent to and below the closure plate. Just below the sidewall openings, a check valve is provided to allow the escape of air from the mattress, yet prevent air from being drawn into the mattress by suction. Pivotal handles on the threaded cap for the spout may be used to engage the standpipe for lifting it from the spout.

18 Claims, 5 Drawing Sheets

WATERBED MATTRESS AIR BLEEDER VALVE

BACKGROUND OF THE INVENTION

The present invention is directed generally to a waterbed mattress air bleeder valve and more particularly to a standpipe slidably supported within the flexible filler spout of a waterbed mattress for movement between a raised position for supporting a column of water and exhausting air to the ambient atmosphere and a lowered position for closing and sealing the flexible filler spout.

Modern day waterbed mattresses are generally equipped with an industry standard flexible filler spout. That spout includes a peripheral rim sealed to the edge of a filler opening through the top wall of a mattress, a generally cylindrical end fitting and a deformable sleeve connected to and extending between the end fitting and rim for enabling the end fitting to be raised above the rim for filling the waterbed mattress and depressed below the rim during use of the filled mattress.

The spout end fitting is conventionally closed with a removable plug having an inverted top hat shape. The plug is inserted into the spout end fitting prior to threading the cap onto the fitting.

There are two primary problems associated with the conventional industry standard filler spout for waterbed mattresses. First, since the plug is a separate piece that must be removed from the flexible filler spout when bleeding air from the mattress, it can be misplaced, lost or otherwise separated from the mattress. While looking for or replacing the plug, the filled mattress is precariously left with the filler spout open and susceptible to draining water from the mattress. Even if the cap is threaded onto the spout, the cap is not designed to afford a fluid tight seal.

Secondly, the vertical extent of the flexible filler spout, even when elevated to its raised position above its peripheral rim, is limited making it difficult not to force water from the mattress while bleeding the air therefrom. Any spilled water needs to be cleaned up and such clean up may be difficult if the water has seeped into the space between the mattress and the liner. If spillage is not caught by the liner, it may damage adjacent furniture or floor surfaces onto which it spills.

Accordingly, a primary object of the present invention is to provide an improved method and apparatus for bleeding air from a waterbed mattress.

Another object is to provide a waterbed mattress flexible filler spout with a standpipe that is slidably moveable between a raised position operative to bleed air from a mattress and a lowered position operative to close and seal the filler spout.

Another object is to provide the flexible filler spout of a waterbed mattress with an adjustable standpipe capable of containing a water column above the spout end fitting while bleeding air from a waterbed mattress.

Another object is to provide an adjustable standpipe for a conventional waterbed mattress flexible filler spout, which standpipe eliminates the need for the separate conventional plug.

Another object is to provide an improved method of bleeding air from a waterbed mattress which enables a water column to be supported above the open end of the flexible filler spout.

Another object of the invention is to provide an adjustable standpipe for the flexible filler spout of a waterbed mattress, which standpipe includes a check valve to block the passage of air into the waterbed mattress.

Another object of the invention is to provide a waterbed flexible filler spout with an adjustable standpipe which is simple and rugged in construction, inexpensive to manufacture and efficient in operation.

SUMMARY OF THE INVENTION

The present invention provides an adjustable standpipe for the industry standard flexible filler spout of a waterbed mattress. The standpipe includes an elongated tube adapted to be slidably fit within the generally cylindrical end fitting of the waterbed mattress filler spout. A bottom end portion of the tube has an external diameter adapted for a frictional slide fit within the spout end fitting so as to afford a substantially liquid tight seal when the standpipe is lifted to a raised position for bleeding air from the mattress. A lip protrudes outwardly from the bottom end portion of the tube at a position for engaging the underside of the spout end fitting to resist removal of the standpipe from the spout. The lip is small enough that the standpipe can be forcibly removed without damage to the spout.

The top end portion of the standpipe likewise has an external diameter adapted for a frictional slide fit within the spout end fitting to afford a liquid tight seal. A collar protrudes outwardly from the top end portion for engaging the top of the spout to limit downward movement of the standpipe into the spout to its lowered storage position. A transverse closure plate adjacent the top end of the standpipe blocks fluid flow past the plate, but at least one opening is provided through the sidewall of the standpipe below the closure plate for releasing air when the standpipe is in its raised position. A water column is supportable within the standpipe below the sidewall opening to greatly facilitate manipulation of the mattress to force air toward the filler opening without spillage of water.

When the standpipe is pressed downwardly into the spout to its lowered position, it effectively closes and seals the spouts since the sidewall openings are positioned within the mattress below the spout end fitting. A central portion of the standpipe may be formed of reduced diameter to facilitate sliding movement of the spout between the raised and lowered positions.

A check valve may be incorporated into the standpipe below the sidewall openings to allow the escape of air from the mattress, but to prevent air from being drawn back into the mattress through the standpipe.

The threaded cap for the flexible filler spout has a pair of semicircular hinged handles which, upon inversion of the cap, may be engaged around the standpipe collar to assist with lifting the standpipe out of the spout.

DESCRIPTION OF THE PREFERRED EMBODIMENT

Figure 1:
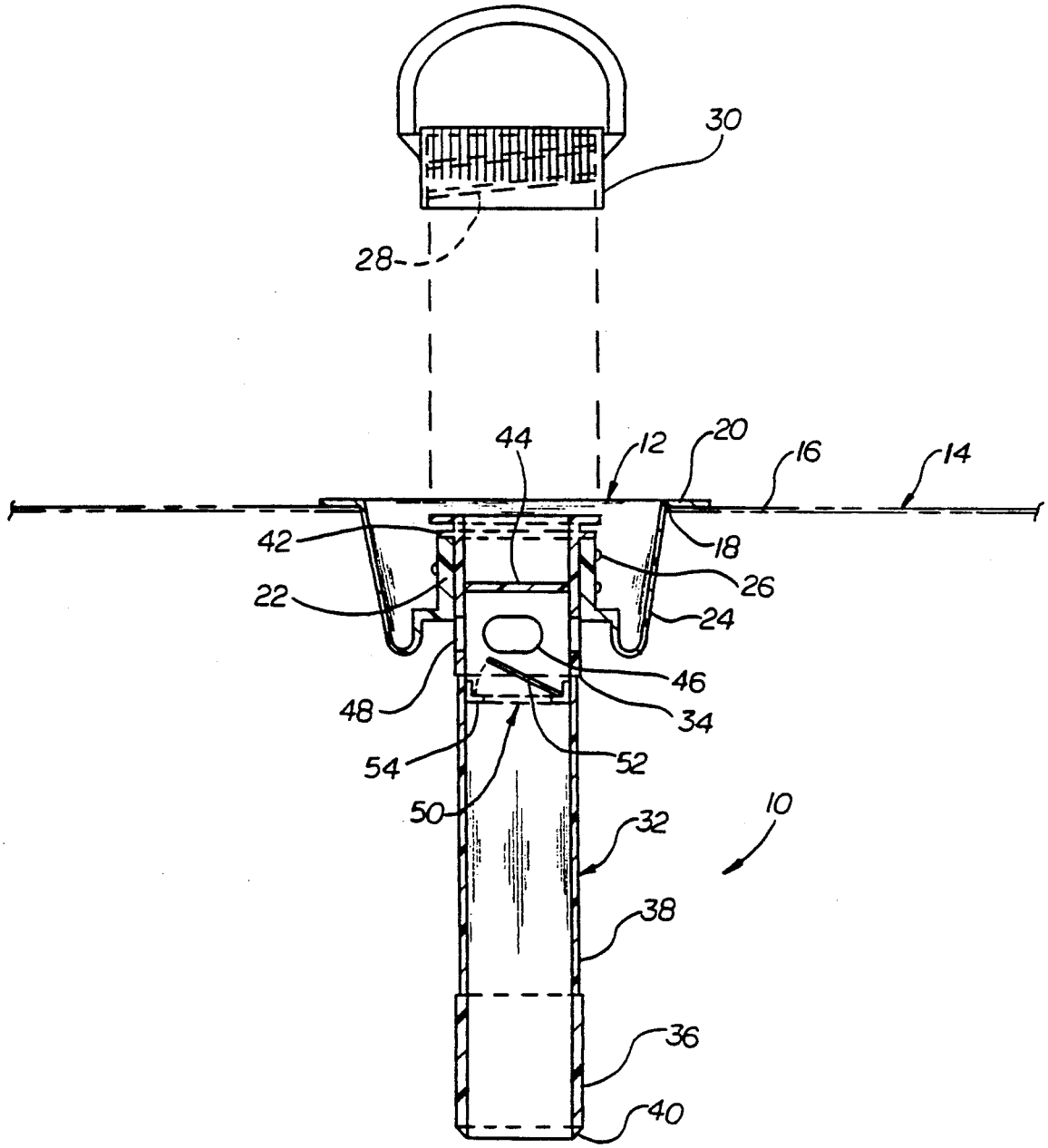
FIG. 1 is a side sectional view of the standpipe of the invention installed within a waterbed mattress flexible filler spout with the threaded cap shown in elevated relation.
Figure 2:
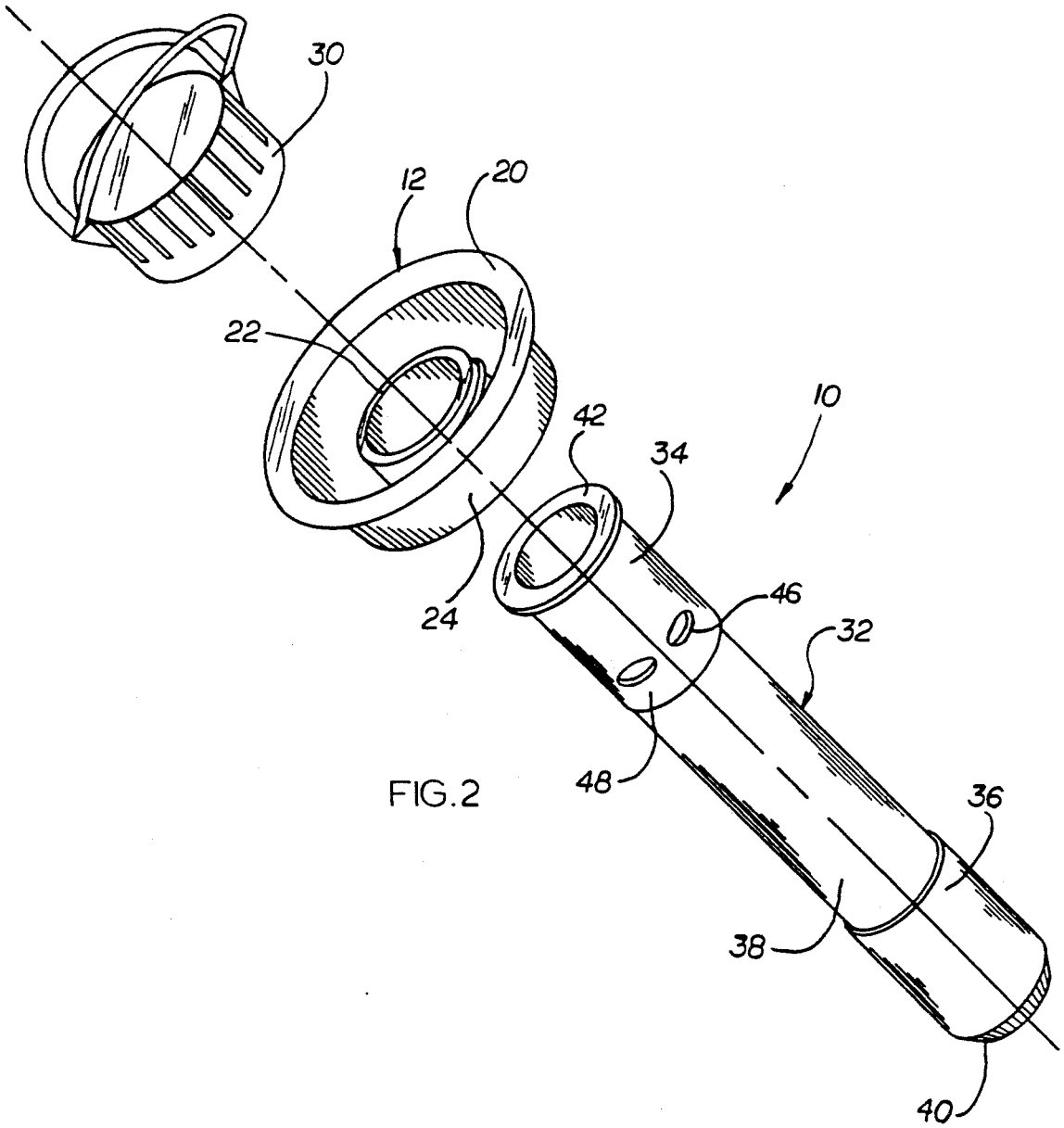
FIG. 2 is a perspective view of the standpipe and flexible filler spout.
Figure 5:
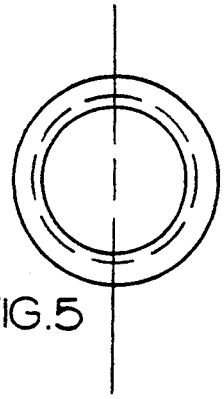
FIG. 5 is a top plan view of the standpipe.
Figure 12:
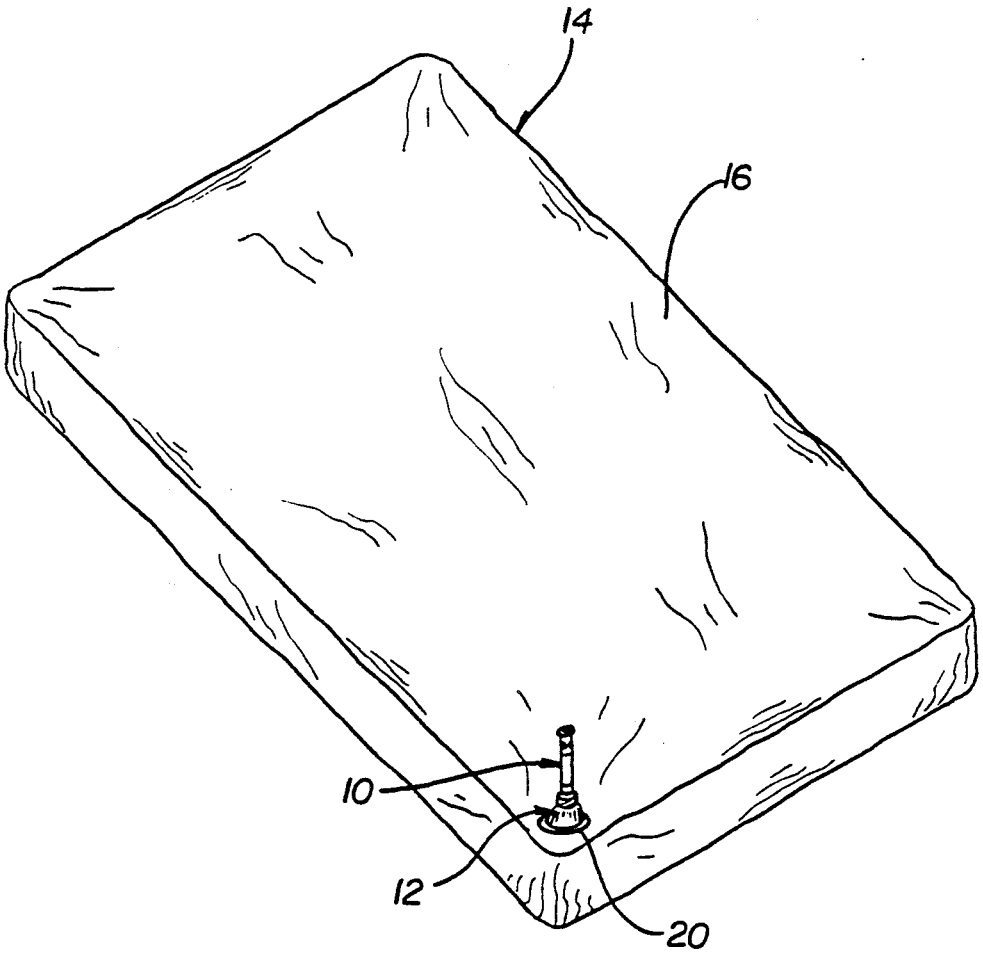
FIG. 12 is a perspective view of a waterbed showing the standpipe and flexible filler spout in the raised positions for bleeding air from the mattress.

The adjustable standpipe 10 of the present invention is illustrated in FIG. 1 in assembly relation with an industry standard flexible filler spout 12 for a waterbed mattress 14. The mattress top wall 16 has a filler opening 18 into which the spout is sealed. Spout 12 includes a peripheral rim 20 sealed to the periphery of filler opening 18, a generally cylindrical end fitting 22 and a deformable sleeve 24 connected to and extending between rim 20 and fitting 22 so that the end fitting can be raised and lowered between the lowered storage position of FIG. 1 and the raised filler position of FIG. 12. The interior surface of end fitting 22 is generally smooth and cylindrical whereas the external surface includes threads 26 for coacting engagement with internal threads 28 on the removable cap 30.

As shown in FIGS. 1–6, standpipe 10 includes an elongated generally cylindrical tube 32 having a top end portion 34 and an open bottom end portion 36. In the preferred embodiment, the external diameter of the top and bottom end portions 34 and 36 are the same. That diameter is selected to afford a frictional slide fit of the respective end portion within the spout end fitting 22 so as to afford a substantially liquid tight seal between the end fitting 22 and respective end portion engaged within it. An elongated central portion 38 of tube 32 may have a reduced external diameter at least slightly less than the diameter of the top and bottom end portions so that the standpipe is easily vertically slidable within the spout end fitting 22 upon movement of the standpipe to a position where the central portion fills the vertical extent of the spout end fitting.

Figure 4:
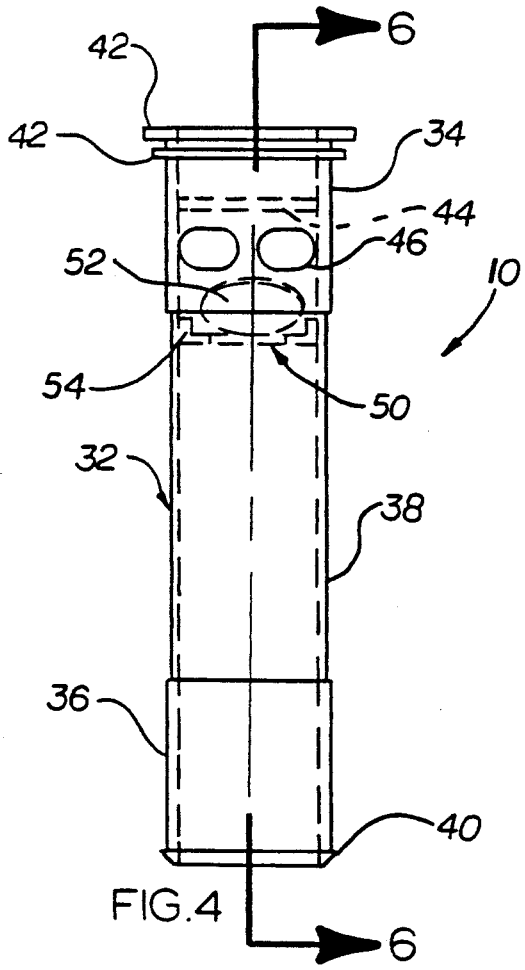
FIG. 4 is a side elevational view of the standpipe with internal structure indicated in dotted lines.

As perhaps shown best in FIG. 4, a lip 40 protrudes outwardly from the bottom end portion 36 of tube 32 at a position for engaging the underside of the spout end fitting 22 upon upward movement of the bottom end portion into the end fitting 22, thereby to resist removal of the standpipe 10 from the spout 12. The extent of protrusion of the lip 40 from the bottom end portion 36 is small enough that the lip can be forced through the end fitting 22 upon upward withdrawal of the standpipe from the fitting without damage to the fitting. The outward extent is sufficient, however, that the user can feel when the lip engages the underside of the spout end fitting 22. The dimension of the outward extent is somewhat exaggerated in FIG. 4 and may be on the order of 0.01".

Likewise, a collar 42 protrudes outwardly from the top end portion 34 for engaging the top of the spout end fitting 22 upon downward movement of the standpipe 10 into the spout for storage. The outward extent of collar 42 is substantially greater than that of the bottom lip 40 so as to afford a rigid stop to prevent the standpipe from being accidentally inserted past the spout into the mattress. Collar 42 is preferably situated at the top edge of tube 32.

A transverse closure plate 44 extends across the top end portion 34 of the standpipe to block fluid flow therethrough. To allow air to escape from the standpipe, one or more openings 46 are formed in the tube sidewall 48 adjacent and below the closure plate 44. Several openings 46 may be arranged in circumferentially spaced relation.

Figure 6:
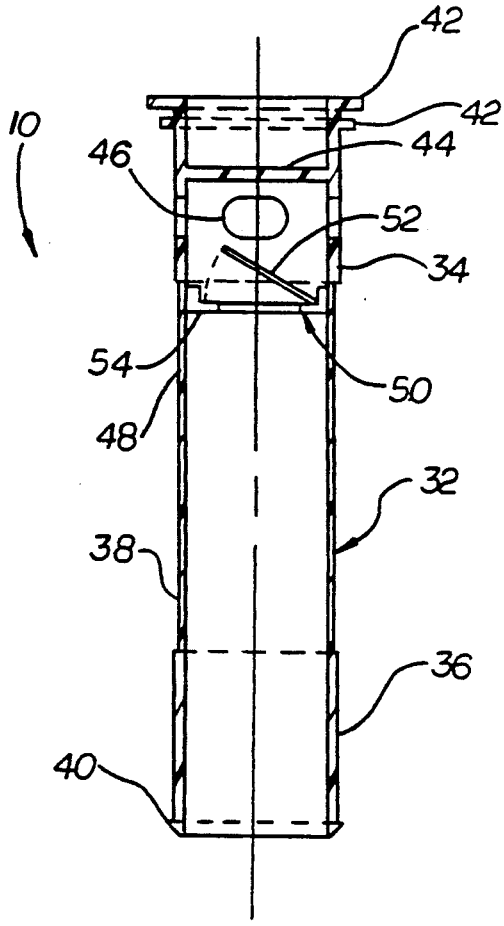
FIG. 6 is a side sectional view of the standpipe showing the flapper valve in a raised open position.
Figure 3:
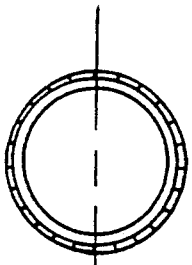
FIG. 3 is a bottom plan view of the standpipe.

A check valve 50 is mounted within tube 32 adjacent to and below the sidewall openings 46. The check valve allows air to pass upwardly through the tube past the check valve. A preferred form of check valve includes the hinged flapper valve 52 shown in FIGS. 4 and 6. A generally annular seat 54 protrudes radially inwardly from the tube sidewall 48 and the flapper valve 52 is hingedly connected to the seat for pivotal movement between a closed position seated upon the seat and an open position inclined upwardly from the seat as illustrated in FIGS. 4 and 6. The check valve is preferably positioned as high as possible within the tube 32, but below openings 46 so as to accommodate the highest possible water column within the limited extent of the standpipe.

Figure 8:
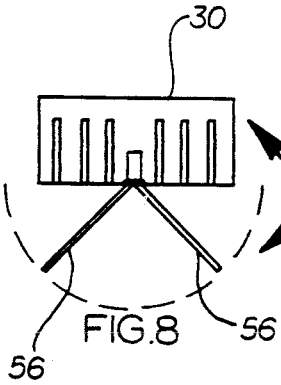
FIG. 8 is a side elevational view of the threaded cap in inverted relation with the handles pivoted downwardly for engaging the standpipe.
Figure 7:
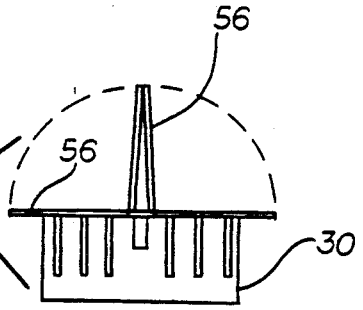
FIG. 7 is a side view of the threaded cap for the spout.
Figure 9:
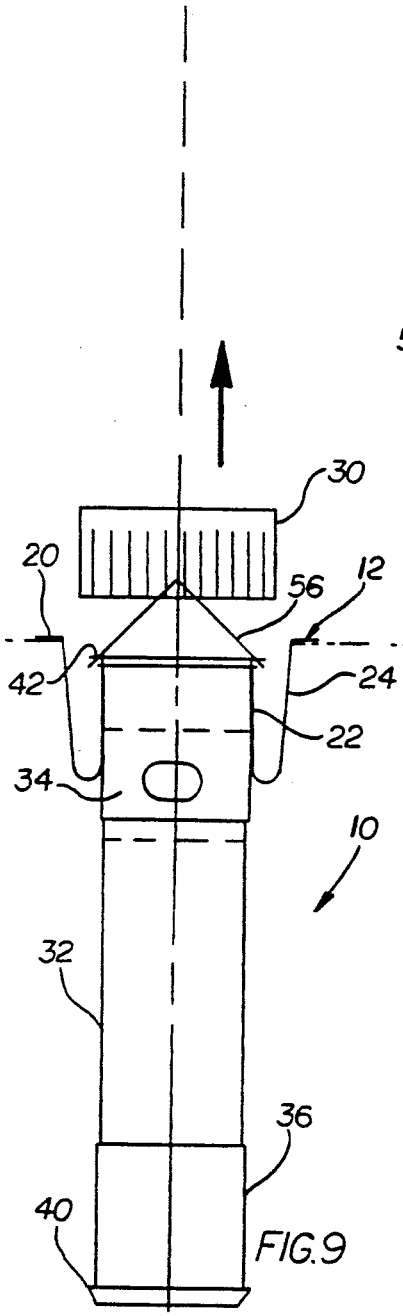
FIG. 9 is a diagrammatic side view showing the top collar of the standpipe being engaged by the cap handles.
Figure 10:
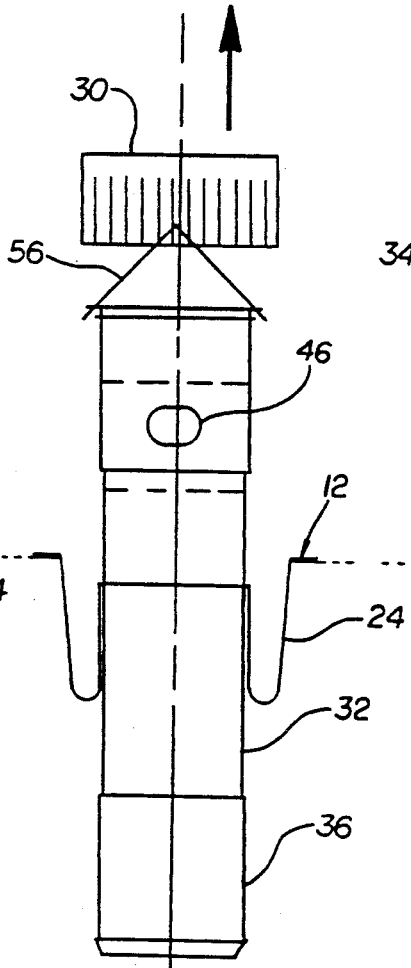
FIG. 10 is a diagrammatic side view of the standpipe being lifted by the cap.
Figure 11:
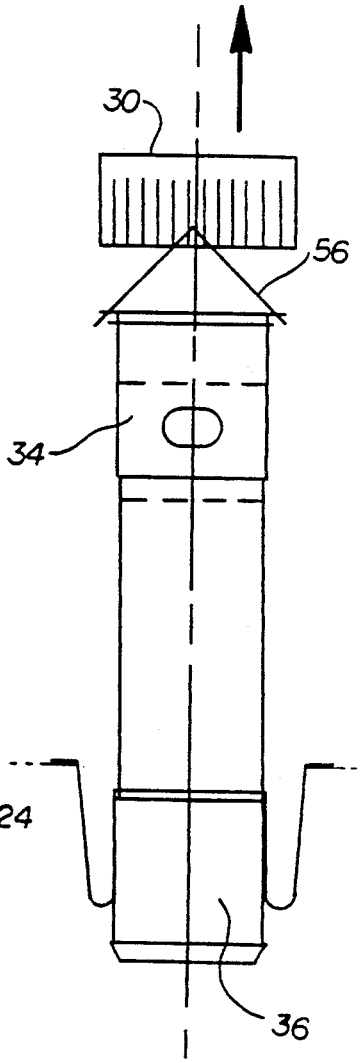
FIG. 11 is a side view of the standpipe being further lifted within the spout.

FIG. 7 shows that the cap 30 for the spout 12 has a pair of hinged semicircular handles 56 which are pivotally moveable between the raised and lowered illustrated positions. When the cap 30 is inverted, those handles may be spread apart as indicated in FIG. 8 and lowered into engagement with the collar 42 of standpipe 10, as shown in FIG. 9. The cap, therefore, serves as a tool for lifting the standpipe up and out from the spout 12. Upon lifting the standpipe to its raised position wherein the bottom lip 40 engages the underside of the spout end fitting 22, additional force may be applied to remove the standpipe from the spout. A hose or other water source can then be used for filling the waterbed mattress through the open spout 12. When filling of the waterbed mattress is nearly completed and it is desired to bleed the remaining air from the mattress, the standpipe 10 is reinserted through spout 12 to the raised position with lip 40 engaging the underside of the spout end fitting 22. Throughout the filling of the mattress, the spout end fitting is lifted to a raised position above rim 20 as accommodated by the deformable sleeve 24.

To bleed air from the mattress, the mattress top wall 16 is manually depressed at selected positions to force trapped air toward the spout 12. During this process, pressure within the mattress may cause a water column to rise within standpipe 10. By containing that water column, the standpipe enables faster and less precise manipulation of the top wall without the danger of spilling any water that rises above the top of the spout. As air approaches the underside of spout 12, the buoyant force of the water directs the air upwardly through the standpipe, through check valve 50 and out the sidewall openings 46. Any wave action or other water movement that may tend to draw air back in through the standpipe is rendered ineffective by the closing of check valve 50 in response to any downward suction through the standpipe.

Upon removal of substantially all air from the mattress, the standpipe is depressed into spout 12 to close and seal the end fitting 22. That end fitting is then pressed downwardly into the mattress through rim 20 so as to eliminate any protrusion of the spout above the surface of the mattress top wall 16.

Figure 13:
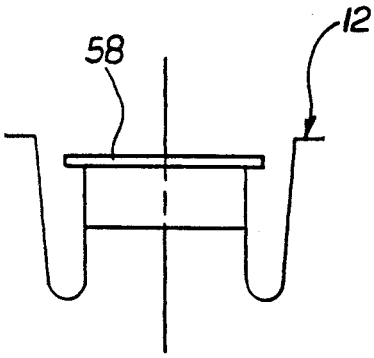
FIG.13 (PRIOR ART)
FIG. 13 is a diagrammatic side view illustrating the separate prior art plug for the filler spout.
Figure 14:
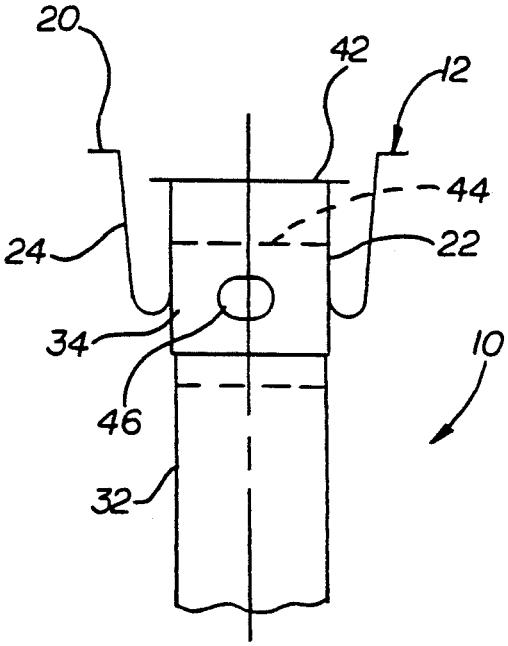
FIG. 14 is a partial diagrammatic side elevational view showing the standpipe in its lowered storage position.

FIG. 13 diagrammatically illustrates the generally inverted top hat-shaped plug 58 that has been conventionally employed to close and seal the spout end fitting 22. The need for such a plug is eliminated by the standpipe of the present invention, the uppermost portion of which is substantially identical to the conventional plug. The tube sidewall 48, however, extends substantially below the closure plate 44 to afford the standpipe capability of the invention. The standpipe 10 can be elevated to its raised position for bleeding air from the mattress without physically detaching or removing the standpipe from the spout 12 thereby protecting against misplacing or loosing a separate piece such as the conventionally known plug.

The standpipe 10 is preferably formed of a rigid plastic material capable of forming an effective seal with the resilient deformable material of the flexible filler spout 12.

Whereas the invention has been shown and described in connection with a preferred embodiment thereof, it is understood that many modifications, substitutions and additions may be made which are within the intended broad scope of the appended claims.

I claim:

1. A standpipe adapted to facilitate bleeding of air through the flexible filler spout of a waterbed mattress, which spout includes an outermost generally cylindrical end fitting, said standpipe comprising, an elongated generally cylindrical tube having a top end portion and an open bottom end portion, said top end portion having an external diameter such that the top end portion is adapted for a frictional slide fit within said end fitting so as to afford a substantially liquid tight seal between said top end portion and said end fitting, and further comprising a collar protruding outwardly from said top end portion for engaging the top of the spout end fitting upon downward movement of said standpipe into said spout for storage, a transverse closure plate across said top end portion of said tube to block fluid flow therethrough, said tube including a sidewall having at least one opening therethrough adjacent and below said closure plate for release of air therethrough, said bottom end portion having an external diameter such that said bottom end portion is adapted for a frictional slide fit within said end fitting so as to afford a substantially liquid tight seal between said end portion and said end fitting, and a lip protruding outwardly from the bottom end portion of the tube at a position for engaging the underside of the spout end fitting upon upward movement of said bottom end portion in sealed relation within said end fitting thereby to resist removal of said standpipe from the spout.

2. The standpipe of claim 1 wherein the extent of protrusion of said lip from said bottom end portion is small enough that said lip can be forced through said end fitting upon withdrawal of said standpipe therefrom without damage to said end fitting.

3. The standpipe of claim 2 wherein said lip has a bottom surface which tapers downwardly and inwardly to facilitate downward insertion of said bottom end portion of said standpipe into a spout end fitting.

4. The standpipe of claim 3 wherein said lip is axially situated adjacent the bottom end of said bottom end portion.

5. The standpipe of claim 4 wherein said lip extends around the periphery of said bottom end portion.

6. The standpipe of claim 1 wherein said at least one opening through said tube sidewall is one of a plurality of said openings arranged in circumferentially spaced relation around said sidewall.

7. The standpipe of claim 1 further comprising a check valve mounted within said tube adjacent to and below said sidewall opening, said check valve being operative to pass airflow upwardly through said tube past the check valve, but to block airflow downwardly through said tube past the check valve.

8. The standpipe of claim 7 wherein said check valve includes a generally annular seat protruding radially inwardly from said tube sidewall and a flapper valve hingedly connected to said seat for pivotal movement between a closed position seated upon said seat and an open position inclined upwardly from said seat.

9. The standpipe of claim 1 wherein said tube includes a central portion connected to and extended between said top end portion and bottom end portion, the external diameter of said central portion being at least slightly less than the external diameter of said end portions so that said standpipe is easily vertically slidable within the spout end fitting upon movement of the standpipe to a position where said central portion fills the vertical extent of said spout end fitting.

10. In combination, a flexible filler spout for a waterbed mattress, said flexible filler spout including a peripheral rim adapted to be sealed to the periphery of a filler opening through a waterbed mattress, a generally cylindrical end fitting, and a deformable sleeve connected to and extending between said end fitting and peripheral rim whereby said end fitting may be raised and lowered above and below the level of said peripheral rim, a removable cap, coacting threads on said cap and spout end fitting whereby said cap may be threadably secured onto said end fitting, a standpipe adapted to facilitate bleeding of air from a waterbed mattress through said flexible filler spout, said standpipe comprising, an elongated generally cylindrical tube having a top end portion and an open bottom end portion, said top end portion having an external diameter such that said top end portion is adapted for a frictional slide fit within said end fitting so as to afford a substantially liquid tight seal between said top end portion and said end fitting, and further comprising, a collar protruding outwardly from said top end portion for engaging the top of the spout end fitting upon downward movement of said standpipe into said spout for storage, a transverse closure plate across said top end portion of said tube to block fluid flow therethrough, and said tube including a sidewall having at least one opening therethrough adjacent and below said closure plate for release of air therethrough upon movement of said standpipe to a raised position wherein said lip engages the underside of the spout, said bottom end portion having an external diameter such that said bottom end portion is adapted for a frictional slide fit within said end fitting so as to afford a substantially liquid tight seal between said bottom end portion and said end fitting, and a lip protruding outwardly from the bottom end portion of the tube at a position for engaging the underside of the spout end fitting upon upward movement of said bottom end portion in sealed relation within said end fitting thereby to resist removal of the standpipe from said spout.

11. The combination of claim 10 wherein the extent of protrusion of said lip from said bottom end portion is small enough that said lip can be forced through said end fitting upon withdrawal of said standpipe therefrom without damage to said end fitting.

12. The combination of claim 11 wherein said lip has a bottom surface which tapers downwardly and inwardly to facilitate downward insertion of said bottom end portion of said standpipe into the spout end fitting.

13. The combination of claim 10 further comprising a check valve mounted within said tube adjacent to and below said sidewall opening said check valve being operative to pass airflow upwardly through said tube past the check valve, and to block airflow downwardly through said tube past the check valve.

14. The combination of claim 13 wherein said check valve includes a generally annular seat protruding radially inwardly from said tube sidewall and a flapper valve hingedly connected to said seat for pivotal movement between a closed position seated upon said seat and an open position inclined upwardly from said seat.

15. The combination of claim 10 wherein said top end portion has an external diameter such that said top end portion is adapted for a frictional slide fit within said end fitting so as to afford a substantially liquid tight seal between said top end portion and said end fitting, and further comprising, a collar protruding outwardly from said top end portion for engaging the top of the spout end fitting upon downward movement of said standpipe into said spout for storage, and a transverse closure plate across said top end portion of said tube to block fluid flow therethrough, and said tube including a sidewall having at least one opening therethrough adjacent and below said closure plate for release of air therethrough upon movement of said standpipe to a raised position wherein said lip engages the underside of the spout.

16. The combination of claim 10 wherein said removable cap includes a pair of generally semicircular handles pivotally connected thereto for pulling the spout end fitting upwardly above the level of the peripheral rim thereof, said pivotal handles being engageable with the underside of said collar upon removal of the cap from the end fitting and inverting the same so that said cap is useful as a tool for withdrawing the standpipe upwardly through the spout end fitting for bleeding of air from a waterbed mattress.

17. In combination, a waterbed mattress including a top wall, bottom wall and peripheral sidewall connected together to define a fluid containment chamber, said top wall having a filler opening therethrough, a flexible filler spout for a waterbed mattress, said flexible filler spout including a peripheral rim adapted to be sealed to the periphery of a filler opening through the waterbed mattress, a generally cylindrical end fitting and a deformable sleeve connected to and extending between said end fitting and peripheral rim whereby said end fitting may be raised and lowered above and below the level of said peripheral rim, a removable cap, coacting threads on said cap and spout end fitting whereby said cap may be threadably secured onto said end fitting, and a standpipe adapted to facilitate bleeding of air from a waterbed mattress through said flexible filler spout, said standpipe comprising, an elongated generally cylindrical tube having a top end portion and an open bottom end portion, said bottom end portion having an external diameter such that said bottom end portion is adapted for a frictional slide fit within said end fitting so as to afford a substantially liquid tight seal between said bottom end portion and said end fitting, and a lip protruding outwardly from the bottom end portion of the tube at a position for engaging the underside of the spout end fitting upon upward movement of said bottom end portion in sealed relation within said end fitting thereby the resist removal of the standpipe from said spout, said top end portion of the tube having an external diameter such that said top end portion is adapted for a frictional slide fit within said end fitting so as to afford a substantially liquid tight seal between said top end portion and said end fitting, a collar protruding outwardly from said top end portion for engaging the top of the spout end fitting upon downward movement of said standpipe into said spout for storage, a transverse closure plate across said tube adjacent said top end portion to block fluid flow therethrough, and said tube including a sidewall having at least one opening therethrough adjacent and below said closure plate for release of air therethrough upon lifting said standpipe to an elevated position wherein said bottom end portion is frictionally slide fit within the spout end fitting.

18. A method for bleeding air from a waterbed mattress, said mattress including a filler opening in the top wall thereof and a flexible filler spout including a peripheral rim sealed to the mattress top wall around said opening, a generally cylindrical end fitting and a deformable sleeve connected to and extending between said rim and end fitting, and a cap threadably engaged on said end fitting, comprising, providing an elongated standpipe having an external diameter adapted for frictional slide fit within said end fitting, a bottom lip and top collar engageable with said spout end fitting to resist sliding movement of the standpipe from the end fitting, a closure plate across the standpipe adjacent the top end thereof and an opening through a sidewall of the standpipe adjacent to and below the closure plate, lifting said spout end fitting above the peripheral rim of the spout, raising said standpipe within said spout end fitting to an extent that the sidewall opening is above the spout end fitting, manipulating the top sheet of the mattress to force trapped air in the mattress toward the flexible filler spout thereby directing air upwardly through the standpipe and effecting a water column within said standpipe above the spout end fitting at times, depressing said standpipe into said spout end fitting to the extent of engagement of the top collar with said spout end fitting thereby closing and sealing said spout end fitting, depressing the spout end fitting below the peripheral rim of the spout, and threading said cap onto said spout end fitting to secure said stand pipe in depressed sealed relation therein.

* * * * *